United States Patent [19]

Crump

[11] 4,320,918

[45] Mar. 23, 1982

[54] EQUIPMENT ASSEMBLING, CARRYING AND, OR, SECURING DEVICE

[76] Inventor: John M. Crump, 1018 Parkridge Cir. W., Jacksonville, Fla. 32211

[21] Appl. No.: 179,093

[22] Filed: Aug. 18, 1980

[51] Int. Cl.[3] ..... A45F 5/10

[52] U.S. Cl. ..... 294/147; 294/163; 294/165

[58] Field of Search ..... 224/45 P, 45 Q, 45 S, 224/45 R, 50, 917; 12/120.5; 294/147, 163, 165

[56] References Cited

U.S. PATENT DOCUMENTS

| | | | |
|---|---|---|---|
| 2,956,813 | 10/1960 | Madden | 224/45 S |
| 3,209,970 | 10/1965 | Canell | 224/917 X |
| 3,210,787 | 10/1965 | Allsop | 12/120.5 |
| 3,248,027 | 4/1966 | Pfleider | 224/45 S |
| 3,260,430 | 7/1966 | Sandenburgh | 224/45 S |
| 3,272,413 | 9/1966 | Pfleider | 224/45 S |
| 3,718,242 | 2/1973 | Larson | 224/45 S |
| 3,909,718 | 9/1975 | Allsop et al. | 224/45 S |
| 3,990,655 | 11/1979 | Coyell | 224/45 S |
| 4,190,182 | 2/1980 | Hickey | 224/45 S |

*Primary Examiner*—Steven M. Pollard

[57] ABSTRACT

The invention is a device for assembling, transporting, displaying, packaging, carrying and, or, securing any desired combination of equipment such as skis, poles and boots. The device includes oppositely disposed equipment retainer means symmetrically related and movably mounted in a mutually aligned relationship relative to a base member. Said retainer means being selectively adjustable to allow any desired combination of said equipment, or the like, to be retained therewith. Manipulatable securing means is provided such that the said retainer means may be adjusted to accommodate various equipment sizes and also to provide a method whereby the consequential assembling of any combination of said equipment causes said equipment to be releasably secured therewith and further providing means incorporated into the same device for locking said device with a cable type security lock, or the like.

21 Claims, 9 Drawing Figures

EQUIPMENT ASSEMBLING, CARRYING AND, OR, SECURING DEVICE

DESCRIPTION

1. Technical Field

The present invention relates to a device for carrying, storage, transporting, assembling, packaging, displaying and, or, securing any combination of equipment such as skis, poles and boots, or the like, while simultaneously providing a method of assembling such equipment in a single, integral means for securing the complete device and any combination of equipment retained therewith when a skier leaves the equipment unattended in a ski resort, public area, or any place where convenience and security are desired for such equipment.

2. Background Art

The prior art, U.S. Pat. No. 3,210,787, provides for boot carrying only. U.S. Pat. No. 3,990,655 provides for ski and pole carrying and securing. Each of these devices is limited to their independent uses.

This applicant has disclosed other embodiments of the present invention in application Ser. No. 06/057,306 dated July 13, 1979, 06/125,340 dated Feb. 28, 1980, and 06/128,673 dated Mar. 10, 1980, 06/175,081 dated Aug. 4, 1980, 06/176,787 dated Aug. 18, 1980 and 06/179,093 dated Aug. 18, 1980.

DISCLOSURE OF INVENTION

In accordance with the present invention, I provide a method of assembling skis, poles and boots, or the like, into a single, integral device having cooperable members for carrying and, or, securing any desired combination of equipment such as skis, boots and poles. The device includes a pair of mutually aligned oppositely disposed and symmetrically related cooperable retainers, each selectively movable on a centrally located column member, one of the retainers being adapted to cooperate with a base portion and the boots to form a pair of ski and pole magazine retention chambers. The device consisting of a unitary mechanism having relatively symmetrically configured movable parts that may be selectively manipulated into variable positions to receive boots, skis and poles into releasable securement therewith and which may be locked in their enclosed or retaining positions.

My improved carrying and securing device provides a novel method of assembling and the advantage that the cooperable parts are adjustable and selectively manipulatable by a means disposed within the hand grasp structure thereby allowing the device to not only be utilized to accomodate the full range of equipment sizes but to also be retracted to a minimum height when the device is utilized for carrying and, or, securing skis and poles without boots.

The single adjustable securing and locking means located in the hand grasp structure is common to all adjustment and utilization features inherent in this invention such that the device is positively secured in a selected equipment retention position. This feature is of particular advantage since it provides in one single device the capability and methods of carrying and, or, securing any desired combination of skis, poles and boots. Other objects and advantages reside in certain novel features of the method of assembly, arrangement and combination of parts which will be hereinafter more fully described and particularly pointed out in the appended claims, reference being made to the accompanying drawings forming a part of this specification.

BRIEF DESCRIPTION OF DRAWINGS

The details, features and principles of my invention, as well as further objects and advantages will be more fully understood by reference to the accompanying drawings and following detailed description, which disclose, by way of example the presently preferred but none the less illustrative embodiment in accordance with the mode contemplated of applying that principle, in which.

BEST MODE FOR CARRYING OUT THE INVENTION

Figure 1:
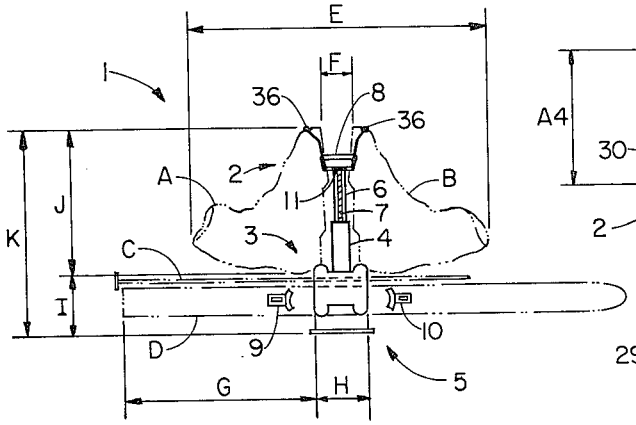
FIG. 1 is a view in side elevation illustrating the method of assembling a class of equipment embodying the present invention.

Referring now specifically to the drawings and first to FIG. 1, there is shown and illustrated a method of assemblage embodying features and principles of the present invention, generally designated by the reference numeral 1, which includes a pair of boots A and B together with a pair of skis D and their accompanying poles C secured into the illustrated assemblage by means of a centrally disposed device comprising a pair of mutually aligned, selectively manipulatable, and cooperative boot retainer units 2 and 3 each slidable or movably mounted to a base column 4 which in cooperation with base member 5, handle column 6, securing means 7 and hand grasp 8 provide a means for selectively carrying and, or, securing any combination of boots, skis and poles. Skis D are confined longitudinally within base 5 by ski bindings 9 and 10. FIG. 1 illustrates an assemblage of equipment having a characteristic longitudinal side profile with dimensions E, F, G and H and compact vertical dimensions I, J and K. Observe that when boots A and B are not secured therewith dimension J becomes substantially zero thus causing dimension K to approach dimension I. When skis D and poles C are not secured therewith dimension K approaches dimension J. Dimension F may be selected in cooperation with securing means turning disk 11 in order to achieve adequate operational freedom together with hand grasp comfort.

Figure 2:
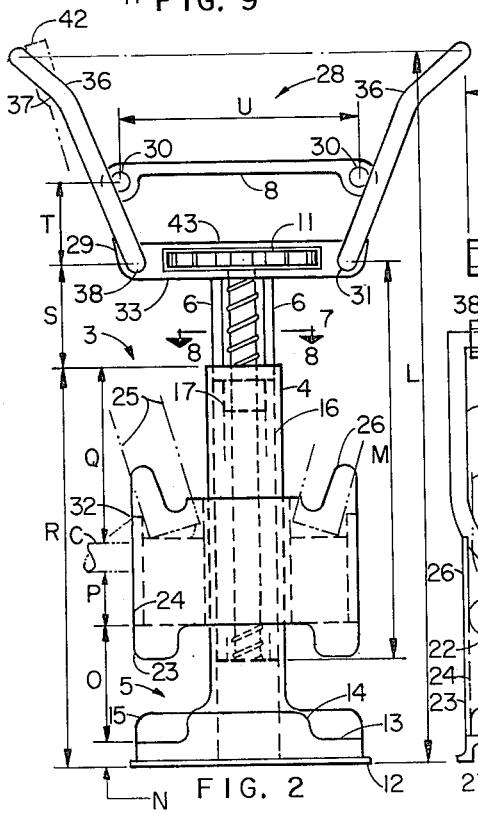
FIG. 2 is a side view, illustrating the device in a partial extended position as at the beginning of an equipment assembling operation or conclusion of an equipment removal operation.

The broad theory of the carrying and, or, securing principles of this invention are further disclosed in FIG. 2 wherein the base member 5 is shown as being generally rectangular in shape or configuration including arcuate flanges 12 and portions thereof at different levels to form the lower part of a pair of oppositely disposed ski chambers having substantially flat ski support bases 13, upstanding longitudinally extending side walls 14 and centrally disposed upstanding base column member 4. End walls 15 extend longitudinally from base column 4 providing interior side walls for ski chambers and structural reinforcing for base member 5 and column 4. Base column member 4 has a central cavity 16 thus providing a receiving opening for adjustable handle column members 6 and 7. Thus FIG. 2 illustrates, among other things, the synergistic characteristics of base column member 4 as it cooperates with the selectively manipulatable parts 3, 6 and 7. Observe now in FIGS. 2, 3 and 4.

Lower boot, ski and pole retainer unit 3 comprised of two symetrically disposed longitudinally extending pole chambers 22 with downwardly depending side walls 23 having central located recess portions generally terminating to cooperate with side walls 14 of base member 5. Unit 3 is generally rectangular in shape conforming substantially to the plan configuration of base member 5. However, for simplicity of description Unit 3 and its side walls 24 are shown having a substantially open top structure bridging therebetween with symetrically disposed upstanding boot retention lips 32 generally perpendicular to axis of pole chambers 22 and integral with side walls 24 which in turn comprises part of the ski retention means. Lips 26 extend upward and partially along side walls 24 forming side retention lips which facilitate holding of boots and also reinforce the structural unit 3. A centrally located aperture extends through Unit 3 being formed by perimeter walls 27. The pole chambers 22 may be provided with reinforcing ribs (not shown) to aid in lending rigidity to the structure and providing snap-in releasable pole holding features. In a similar manner, the side walls 24 may be provided with reinforcing ribs for added strength and structural rigidity. Perimeter walls 27 forming a central aperture through Unit 3 are shaped to conform with exterior configuration of column 4 thus guiding Unit 3 vertical motion and restraining against rotational motion.

Slidably mounted within base column 4 are handle column members 6 and 7 adapted to cooperate with adjusting nut 17 which in conjunction with securing means 7 provides for adjustment and locking of device 28 in FIG. 2 and device 1 in FIG. 1. Symetrically disposed and extending upwardly from handle column 6 are a pair of generally upstanding sloping, substantially, similar, handle hand grasp end abutments 29. Said abutments 29 are disposed transversely to the longitudinal axis of pole chambers 22 and form the end walls of hand grasp 8. The abutments 29 are each formed with a pair of openings 30 and 31 for the purpose of rotatably supporting boot retainers 36 which may be selectively installed in either openings 30 or 31 depending upon length of boots A and B relative to extended length L of device 28 in FIG. 2. Openings 30 are optional.

Retainers 36 include boot interface portions 37 and rotation support shaft 38 and may be formed for key-in type fastening 38 (shown in FIG. 3) in openings 30 or 31. Thus, once the retainer shafts 38 are inserted into openings 30 or 31, and their ends snap locked or keyed together, the retainers 36 are free to rotate within zones identified best in FIG. 4, but cannot be removed from the openings since there is no access to unsnap the snap lock (not shown), or retainers 36 cannot be rotated to the position where the shaft 38 is not keyed to openings 30 or 31. The exterior flat surface of abutments 29 are sloped to cooperate with boots A and B relative to lower boot retention lips 32. Integral with abutments 29 and bridging therebetween is a substantially flat hand grasp lower structure 33 provided with an aperture 34 having disposed therein securing means adjustment disk 11.

As best seen in FIGS. 2, 8, 9 and 10, securing means 7 is detachable and adjustably engaged to Nut 17 which is captured inside base column 4 by means of guide keys 21 cooperating with keyways 20 or other equivalent means. Observe in FIG. 5 that securing means 7 is rotated or manipulated by means of adjustment disk 11 provided with locking cable openings 35 for passage of a locking cable (not shown). The engagement of means 7 to central aperture 19 of Nut 17 provides for adjustment and releasable securement regardless of the combination of equipment assembled therewith. Preferably, the outer peripheral surface of disk 11 is knurled, roughened or provided with turning ribs in order to facilitate manipulation. In FIG. 2 column members 6 and 7 have dimension M with column 4 having dimension R.

Handle columns 6 have been illustrated as generally rectangular in cross section conforming generally to aperture in column 4. It should be noted that the cross sectional configuration of column 4 and columns 6 may be any shape consistent with the functional and structural features of the invention. This includes circular members and multiple members to achieve both stability and adjustment. The lower end of column 6 may be provided with means (not shown) whereby columns 6 cannot be accidently fully retracted from column 4.

Figure 3:
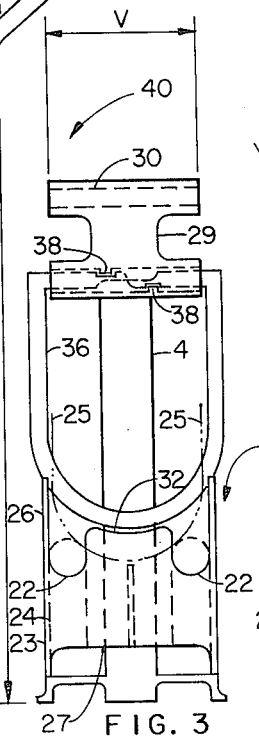
FIG. 3 is an end view illustrating the device in retracted position.
Figure 4:
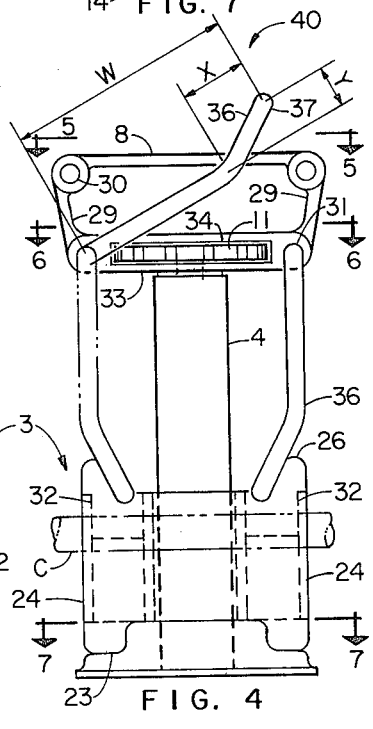
FIG. 4 is a side view illustrating the device in a retracted position.

Turning now to FIGS. 3 and 4 there is shown device 40 with hand grasp 8 retracted downwardly to base column 4 illustrating the general configuration of the invention without boots A and B. Boot retainers 36 may be rotated downwardly into a position generally parallel with vertical axis of base column 4. Securing means 7 has been manipulated to achieve the mutually cooperative position of parts 36 and boot retainer Unit 3 thereby providing a device 40 for carrying and, or, securing poles C and skis D. Observe that the cooperable aspects of securing means 7 with columns 4 and 6 together with Unit 3 allows Unit 3 to be moved upward to a position as shown in FIG. 2 to accomodate skis having dimensions O. Dimensions Q and S vary to suit equipment while dimensions N, P, T, U, V, W, X and Y remain relatively fixed.

Figure 5:
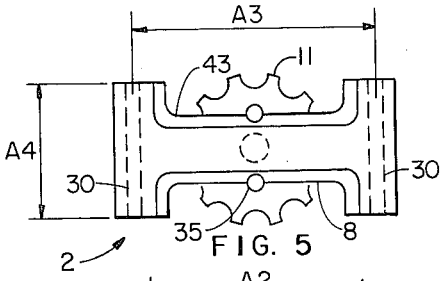
FIG. 5 is a plan view taken on the line 5—5 of FIG. 4.
Figure 6:
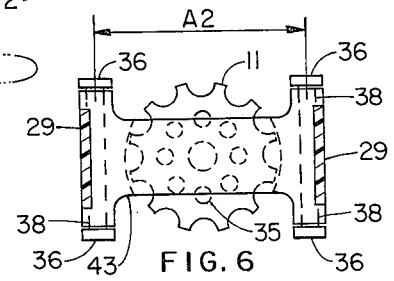
FIG. 6 is a plan view taken on the line 6—6 of FIG. 4.
Figure 9:
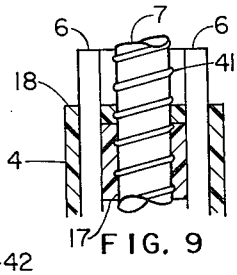
FIG. 9 is a partial section view taken on line 9—9 of FIG. 8.
Figure 8:
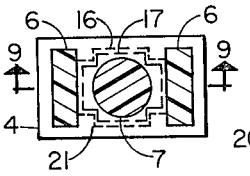
FIG. 8 is a plan view taken on the line 8—8 of FIG. 2.
Figure 10:
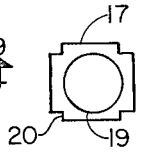
FIG. 10 is an isolated plan view of adjusting nut.
Figure 7:
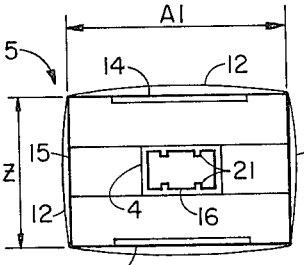
FIG. 7 is a plan view taken on the line 7—7 of FIG. 4.

FIGS. 5 and 6 shows the relationship of securing means adjustment disk 11 to hand grasp 8 located generally centrally between dimensions A3, A4 and A2. Disk 11 is provided with multiple locking cable openings 35. FIG. 7 shows a plan view of base member 5 illustrating generally central located column 4. Column 4 being made with an interior cavity 16 having multiple guide Keys 21 for cooperation with columns 6 and Keyways 20 on adjustment Nut 17. Base member 5 is generally configured rectangular with dimensions A1 and Z having arcuate flanges 12. Upstanding side walls 14 cooperate with Unit 3 to retain skis D.

While plastic is considered the suitable material it is understood that the device 40 can be manufactured from a variety of materials including wood, and skeletonizing metal wire forming. Furthermore, the selection of alternate materials introduces considerations of engineering properties such as shear strength, yield, tensile strength, density, poisson's ratio, fatigue strength, corrosion resistance and other properties which when considered together with the fabrication tooling techniques can have an influence upon members and, the exterior appearance of device 40, while at the same time utilizing the novel characteristics of the invention described hereinbefore. Thus, the three main parts 2, 3 and 5 are each preferably formed as unitary members molded from a suitable plastic each cooperating with the other to provide the important features of construction necessary for compactness, simplicity, ruggedness, lightweight and uniquely adapted to engage ski equipment utilizing the method of assemblage described herein.

OPERATION OF THE INVENTION

Operationally, device 28 of FIG. 2 provides a method whereby a class of equipment such as skis, poles and boots, may be carried and, or, secured in an assemblage 1 illustrated in FIG. 1. Therefore, device 28 comprises a pair of mutually aligned, selectively manipulatable equipment retainer units 2 and 3 movable mounted for cooperating with a base member 5 whereby any combination of boots A and B, poles C and skis D may be assembled therewith and subsequently releasably engaged therewith by manipulation of securing means 7 such that the consequential selective engagement of the cooperable parts thus illustrated causes any desired combination of equipment such as skis D, poles C and boots A and B to be releasable secured with device 28.

Assuming an initial device 40 posture as shown in FIGS. 3 and 4 and that it is desired to assemble equipment such as that illustrated in FIG. 1. First, manipulate securing means 7 by counterclockwise rotation of disk 11, assuming right hand threads 41, thereby causing means 7 to move upwardly relative to column 4. Secondly, move lower retention unit 3 upward allowing skis D to be secured into ski chambers generally noted by dimension O in FIG. 2 following which retention unit 3 is lowered downward onto top of skis D. Poles C may now be placed in pole chambers 22. Thirdly, raise retainers 36 up with one hand while placing heel of boot A onto retainer lips 32 following which retainer 36 is placed over the boot toe at 42 as shown in FIG. 2. Fourthly, repeat third step for boot B. Fifthly, apply slight downward force on handle 8 while simultaneously turning disk 11 clockwise thereby causing means 7 to move downwardly into base column 4 thus causing the assembled equipment to be releasably secured with device 40. A locking cable, not shown, may now be communicated through one of openings 35 thereby locking device 40 against unwanted removal and/or use when attached to some convenient stationary object.

Should the initial posture be that of device 40 shown in FIGS. 3 and 4, and it is desired to assemble poles C and skis D without boots A and B, then it is only necessary to manipulate disk 11 counterclockwise causing means 7 to move upward. Lower retainer unit 3 may now be raised upward about base column 4 thereby causing dimension O to enlarge thus providing freedom for installation of skis D after which poles C may be placed in chambers 22 which may be constructed for snap-in type retention to facilitate subsequent handling. With unit 3 held in the upward position skis D are installed onto ski support bases 13 following which unit 3 is lowered thereby causing skis D to be retained within the oppositely disposed and mutually aligned side walls 14 and 23. Install poles C in chambers 22. Rotate boot retainers 36 downward to position shown in FIG. 4. Manipulate disk 11 causing means 7 to move downward thus causing retainers 36 to come in contact with unit 3 thereby causing said equipment to be retained in releasable securement with device 40. A locking cable (not shown) may be communicated through opening 35 thereby locking device 40.

When boots A and B are to be carried and, or, secured with device 40 of FIG. 4, without poles C and skis D, first manipulate securing means 7 counterclockwise causing it to move upward. Rotate boot retainers 36 upward into zone shown in FIG. 2. Install heel of boot A into engagement with boot retention lip 32. Engage boot retainer 36 over boot toe. Repeat the above for boot B. Apply slight downward force upon hand grasp 8 while simultaneously manipulating securing means 7 clockwise until the proper holding force is applied. Boots A and B are now releasably secured with device 40. A locking cable (not shown) may be communicated through opening 35 thereby locking device 40. The cooperative consequence of the above resulting in a device 40 for carrying and, or, securing any desired combination of equipment such as boots, skis and poles.

Although the device 40 has been illustrated and described herein for use in carrying and, or, securing ski equipment, it is evident from a broader standpoint, that the purpose of device 40 is to carry and secure equipment of the nature illustrated whether it be equipment for skiing, hunting, tennis, golf, ice skates, fishing, roller skates, mountain climbing, industrial safety, some form of special tools or some class of special apparatus associated with a particular sport or work speciality which may be domestic or military in application. It should be understood, therefore, that it is not intended to limit the principles of the present invention to ski equipment alone, but rather to equipment according to the utilization principles of the present invention for various other uses, all of which are fully contemplated according to the features of the present invention.

It is instructive to teach certain alternative variations associated with device 40. The preferred embodiment of column members 4 and 6 depends on the details of manufacturing techniques and may be any geometric configuration ranging from circular to rectangular in cross section. The rectangular configuration has been illustrated for simplicity since it is obvious that these members are susceptible of change and modifications without departing from the principles, spirit and novel features of the invention. Resilient snap type retention means for poles C may be positioned any where along the longitudinal axis of pole chambers 22. Various reinforcing ribs may be selectively located to achieve appropriate strength characteristics. Resilient urging bands may be located internal to column 4 thereby providing an optional feature to facilitate equipment installation. Boots A and B of FIG. 1 may be reversed and the heels secured by retainers 36. The infinite adjustability feature of securing means 7 may be achieved by molding threads thereon. Column 4 may also be provided with any one of a variety of cam and ratchet type fastening mechanisms for adjusting columns 6 up and down. Thus, a securing means, of the class illustrated in FIGS. 2, 3, 4, 5, 8, 9 and 10 provided with threaded connections, or other equivalent means for detachably mounting thus allows means 7 to adjust retractile columns 6 along the vertical axis of column 4. Although not illustrated it is obvious that the standard combination type locking cable once attached to device 1 of FIG. 1 may then be attached to any convenient stationary object. Also, it is significant to note that device 40 of FIGS. 3 and 4 may be constructed to carry and, or, secure skis and poles without any provisions for boots A and B. Note in FIG. 2 that the lips 32 of unit 3 may be located substantially at the extreme lower end of column 4 on base 5 thereby converting device 30 to carry and, or, secure boots A and B without any provisions for skis and poles.

To achieve optimum combination of dimensions F, H, A2, A3 V and U together with a functionally satisfactory configuration of disk 11 and securing means 7 it is instructive to teach that disk 11 can have a diameter equal to A4 such that the outer most portion extends as shown in FIG. 5 thereby causing turning disk 11 to be located generally just below handle structure 8 which because of dimension F, shown in FIG. 1, provides greater freedom for operating means 7 when boots A and B are assembled therewith. Furthermore, the turning means 11 can be located within the hand grasp structure 43 and provisions for locking located therewith.

Among the variations suggested and taught by the illustrations and description is a securing means 7 provided with a snap in or keyed member at its lower extremity whereby means 7 is engaged to columns 6 to achieve greater torsional rigidity. Nut 17 may also be provided with means such that it may be held captive in the upper section of column 4. Fully contemplated captive in the upper section of column 4. Fully contemplated within the scope of this invention is a variety of ratchet and pawl and other shear type quick release mechanism. Working models of these and other variations are being tested and investigated. In FIGS. 2 and 4 observe that boot retainers 36 have congruous configuration denoted by dimensions W, X and Y to achieve a mating fit to the boot sole. Many variations are suggested and these are being investigated including the elimination of retainer shaft openings 30.

Therefore, having disclosed the synthesis and analysis of construction features, including variations thereof, it is understood that the fundamental novel aspects of the invention can be achieved using a variety of substitutions and changes without departing from the spirit of the invention. The broad theory for the equipment carrying, securing and assembling techniques of this improved device 40 and assemblage 1 have been illustrated, described and pointed out including the fundamental novel features as applied to a preferred embodiment 28 comprised of, symmetrically related and oppositely disposed, mutually aligned parts manipulatively mounted onto centrally located cooperable column members such that the cooperative consequences results in a device for selectively carrying and, or, securing any desired combination of equipment such as boots A, B, skis D and poles C.

According to the principles of the present invention therefore, methods and procedures for assembling any combination of equipment such as skis, poles and boots are provided within the device 1 of FIG. 1. In a single device 28 illustrated in FIG. 2 the means for carrying and, or, securing any combination of said equipment uniquely retained in assembled interrelated positions, as shown in FIG. 1, ready for transporting, storage, securing and/or locking, or activities associated with the equipment retained therewith. Furthermore, according to the methods and procedural steps, and more specifically, the device of FIG. 1 may be manipulated to provide all of the above features for skis and poles without boots as illustrated by device 40 of FIG. 3. Still further, from FIGS. 1 and 2 it is seen that boots may be afforded all of the above mentioned features without skis and poles. It follows, therefore, that this new device permits the manufacture of a simpler and less expensive device to achieve more combined functions than has heretofore been known.

All in all, the features of my new and improved carrying and, or, securing device bring forth an advancement in the art over prior known devices and with the utilization of structural components and configuration as described produces a synergistic utility effect resulting in improved life and ruggedness for a device of the character described. It will also be recognized and appreciated that the utility of the unique yet simple mechanism, particularly the parts thereof, eliminates the need for maintenance repairs and/or replacement of parts since the structural integrity does not depend upon resilient biasing means. Securing and locking as used in the description hereinbefore refers to the capability of being secured by the owner such that unauthorized removal and/or use will not be permitted. It also means that the equipment is securely held captive with said device.

The selected modifications herein described for the adaptation to a device 28 are set forth for the purpose of completing the disclosure. Depending on the manufacturer and techniques used, components molded from a variety of plastics, or other materials, have a good balance of properties and are adaptable to many design requirements. Decisions regarding which technique is best suited for the present invention rest primarily upon materials, economic, reliability and ease of performance.

Therefore, according to the principles of the present invention, a unique and novel equipment carrying and, or, securing device is provided whereby an integrated method of assembling equipment that functions basically as a unit during transporting, storage or other uses. While it has been shown and described as a plurality of modified arrangements in which the invention may be embodied, it is to be understood that these constructions have been selected for the purpose of illustration and that various changes in size, shape and arrangement of the parts may be made without departing from the spirit of the invention or the scope of the subjoined claims. While I have shown and described constructions in which my invention may be embodied, it is to be understood, therefore, that variations in the construction and arrangement may be made without departing from the spirit and scope of the invention as disclosed in the appended claims, in which it is intended to claim all novelty inherent in the invention as broadly as permissible, in view of prior art. This invention further resides in the construction, combination and arrangement of elements illustrated in the accompanying drawings, and while I have shown thereon preferred embodiments, it is to be understood that the same is susceptible to modifications and changes; and comprehends other details arrangement of elements, features and construction with departing from the spirit of the invention, and that all matters herein set forth or shown in the accompanying drawings are to be interpreted as illustrative and not in the limitng sense. In view of this disclosure, variations and modifications will doubtlessly be generated by others skilled in the art to obtain all, or part of the benefits of this invention without duplicating the framework shown, and I therefore claim all such variations and modifications insofar as they fall within the reasonable spirit and/or scope of my proposals and claims. Thus in addition to the principles of the present invention 1 of FIG. 1, 28 of FIG. 2 and 40 of FIG. 4 methods and procedures for assembling ski equipment, or the like, are provided whereby virtually all standard ski equipment may be uniquely secured in an assembled interrelated position ready for utilization as a multi-function equipment carrying and, or, securing device.

From the foregoing disclosure it will be evident that the method of operating a multi-function device 28 of FIG. 2 provides a unique assembly mechanism particularly adapted for use with ski equipment, or the like, with the consequent benificial assemblage posture illustrated in FIG. 1 wherein the boots may be optionally secured either toe up or toe down and longitudinally congruous with skis and poles. The consequential results of these methods and procedures being a harmonious equipment assembly having a center of gravity below that of the user thus enhancing the users safety during carrying equipment of the class illustrated.

It is the intention, thus, to be limited only as indicated by the scope of the following claims. Accordingly, the scope of the invention should be determined not by the embodiment illustrated, but by the appended claims and their legal equivalents, and all changes which come within the meaning and range of equivalence of the claims are therefore intended to be embraced therein.

The invention is not limited to the particular preferred and illustrated exemplary embodiments that have been disclosed for graphic illumination. A number of further embodiments exist which are within the scope of the present invention and it will be understood that variations or modifications thereof which are within the scope and spirit of the appended claims are fully contemplated.

Having thus described my invention, I claim as new and desire to secure by Letters Patent:

1. A device for carrying and/or securing any desired combination of equipment such as skis, poles and boots comprising:

first retention means for releasable engagement with oppositely disposed boot toes;

second retention means for releasable engagement with oppositely disposed boot heels;

means provided with one of said retention means to retain said skis and poles therewith;

first column assembly and second column member cooperating with said retention means for supporting and guiding the selective manipulation of said retention means into cooperative engagement with said equipment; and manipulatable securing means releasably engaged to said second column member and adjustably disposed on said first column member; said securing means comprises an elongated member having threads located circumferentially along the longitudinal axis with an adjustment means disposed at one extremity, said adjustment means rotatably mounted and releasably supported within an aperture located in a hand grasp structure.

2. In a device as described in claim 1, wherein, said threads adjustably engage with a relatively stationary means located interiorly of said second column member whereby the manipulation of said adjustment means allows said first column assembly to move with respect to said second column member.

3. In a device as described in claim 1, wherein, said adjustment means embodies a plurality of locking cable openings respectively engageable with a locking means when adjusted to cooperative positions with respect to said hand grasp structure.

4. In a device as described in claim 1, wherein, the second column member comprises an elongated column projecting centrally from a horizontal base and adapted interiorly for retractile operation with said first column assembly, said base having integrally formed therewith, at each of two oppositely disposed edges, vertical side walls extending upwardly from the plane and partially along the axis of said base, one of said retainer means having downwardly depending side walls cooperating with side walls on said base thereby forming a pair of ski retention means, one of said retainer means having upward extending lips which in cooperation with said walls form a pair of pole and boot retention means, said first column assembly including a pair of rotatably supported selectively engageable boot retainers oppositely disposed with respect to a hand grasp.

5. In a device as described in claim 4, wherein the first column assembly has vertically oriented handle columns associated therewith, said second column member having elongated internally located keyway passage means receiving said handle columns therein for nonrotation therebetween, said keyway passage means being generally rectangular cross-sectional configuration for receiving handle columns generally of rectangular cross-sectional configuration, said second cooperable part comprising an elongated centrally disposed column having a base member affixed to one end of said frame, said centrally disposed column having a generally rectangular cross-sectional configuration for cooperation with a similar cross-sectional passage disposed centrally on one of said cooperable parts.

6. In a device as described in claim 1 wherein one of the retaining units comprises a pair of rotatably mounted boot, or the like, engaging means with a substantially U-shaped structure converging inward at one end thereof and adapted for keyed shaft engagement into openings provided in a hand grasp structure, said retainers configured for interface engagement with boot toes or boot heels.

7. In a device as described in claim 1 wherein said first column assembly and second column member are symmetrically disposed with respect to the longitudinal axis of said securing means and retractably engaged one to the other.

8. In a device as described in claim 1 wherein said first retention unit comprises an adjustable retainer for supporting a pair of boots by the toes or heels comprising a generally open rectangular structure having generally parallel side walls, upwardly extending retainer lips cooperating with said side walls and interiorly spaced walls to form longitudinally extending pole chamber, downwardly depending side wall portions cooperating with said first column member and a base member to form ski retention means, a centrally disposed aperture for slidably engaging said retainer unit onto said central column member whereby said retainer unit is movably supported for optionally selectable engagement with any combination of said equipment.

9. In combination, oppositely disposed equipment retainer means symmetrically related and movably mounted in a mutually aligned relationship relative to adjustable column members, said retainer means selectively movable by manipulation of a securing means releasably communicating between said column members, said securing means comprises an elongated member having threads located circumferentially along the longitudinal axis with an adjustment means disposed at one extremity, said adjustment means rotatably mounted within an aperture located in a hand grasp structure, one of said retainer means cooperating with a base member and said securing means such that the consequential assembling of any selected combination of equipment such as boots, skis and poles causes said equipment to be releasably secured therewith.

10. In an equipment carrying and/or securing device comprising movable retaining units having oppositely disposed symmetrically related boot, or the like, releasable engaging means, one of said retaining units structure with oppositely disposed downward and upward depending side walls adapted to form ski and pole retention chambers, said retaining units movably guided by a central column member cooperating with an adjustable securing means rotatably mounted within an aperture located in a hand grasp structure whereby said retention units may be manipulated one relative to the other for selectively engaging any combination of said equipment into releasable securement therewith.

11. A device of the character described comprising a pair of mutually aligned and selectively manipulatable cooperative retention units, one of said retention units having means for retaining skis and poles, each of said retention units having releasable boot engaging means, each of said retention units mounted for guided movement on respective central column members, said column members having an adjustable securing means releasable engaged therebetween and rotatably disposed in a hand grasp structure such that the consequential functioning causes said equipment to be releasable secured with said device.

12. In a device for assembling, carrying and/or securing any combination of ski equipment, or the like, such as boots, skis and poles, cooperable retention units, first of said units having symmetrically related boot retaining means oppositely disposed and slidably engaged with respect to a first central column member and adapted with means to urge downward thereby releasably retaining said skis and/or poles, second of said retention units having adjustable securing means disposed at one extremity, said adjustable securing means rotatably supported within means provided in a hand grasp structure.

13. A ski equipment assembling, carrying and/or securing device comprising mutually aligned cooperable parts, boot retention means provided on a first and second of said parts, an adjustable securing means on the first of said parts, said securing means interfitting and rotatably disposed within means located in a hand grasp structure disposed at one extremity of said first part, said parts and said securing means selectively manipulatably whereby said parts may be moved one relative to the other for selectively engaging any combination of ski equipment such as boots, skis and poles into releasable securement therewith.

14. In a ski equipment assembling, carrying, displaying, transporting and/or securing device, cooperable retention units, first of said units having a pair of boot retainers oppositely disposed about a centrally located hand grasp carrying means, second of said units having a pair of congruous boot retainers disposed symmetrically with respect to a pair of ski and pole retention means movably guided on a centrally located column member having a pair of ski support bases disposed at one extremity, and manipulating securing and locking means releasably engaged to said column member, said securing and locking means comprises an elongated member having threads located circumferentially along the longitudinal axis with manipulation means disposed at one extremity, said manipulation means rotatably supported within an aperture located in a hand grasp structure whereby manipulation of said securing and locking means allows any combination of said ski equipment to be releasably assembled, displayed, transported and/or secured therewith.

15. In a method of assembling ski equipment or the like with a device for carrying and/or securing said equipment such as boots, skis and poles; the steps of:

positioning said skis onto ski support bases after which a ski retention unit is moved down into releasable retention therewith;

positioning said poles parallel within oppositely disposed releasable retention chambers;

inserting said boots into releasable engagement with oppositely disposed boot retention means located generally above and perpendicular to the longitudinal axis of said poles and skis; manipulation of a securing means after one or more of the above steps whereby said equipment is releasably retained with said device;

said securing means rotatably mounted within an aperture located in a hand grasp structure.

16. A composite magazine and retainer for carrying and/or securing any combination of equipment such as skis, poles and boots, comprising retractile members selectively movable thereby effectuating the juxtapositioning of said equipment into cooperative assemblage therewith, a manipulatable securing means adjustably communicating with a first column member and releasably engaged to a second column member, said securing means comprises an elongated member having threads located circumferentially along the longitudinal axis with an adjustment means disposed at one extremity, said adjustment means rotatably mounted and releasably supported within an aperture located in a hand grasp structure.

17. An equipment carrying mechanism for selectively securing a first, second or third class of equipment, or any combination thereof, and including base means supporting first, second and third retention units for respectively receiving first, second and third class of equipment into cooperable engagement therewith, said first retention unit adapted for incremental adjustment relative to said base means, said second retention unit movable mounted and guided onto said base means, said third retention units disposed integral with said second retention unit and substantially coextensive therewith, manipulatable securing means adjustably communicating between said first retention means and said base means, said securing means comprises an elongated member having threads located circumferentially along the longitudinal axis with an adjustment means disposed at one extremity, said adjustment means rotatably mounted and releasably supported within an aperture located in a hand grasp structure.

18. In a device as described in claim 1 wherein the method of operating said device provides an assembly mechanism particularly adapted for assembling boots longitudinally congruous and generally above skis and poles, said assemblage comprising a hand grasp structure particularly characterized in that means are provided for boot sole resting along the outer hand grasp abutments and arranged in cooperative relationship with said retention means for maintaining said boots in said assemblage.

19. In a device as described in claim 1 being particularly characterized in that one of said retention means is rotatably mounted and nonreleasably supported within apertures located in said hand grasp structure.

20. In a device as described in claim 1 being particularly characterized in that said securing means adjustably engages to a nut captured inside said second column member, said nut being restrained from rotation by guide keys located along the longitudinal axis of said column member, said guide keys allowing said nut to move longitudinally with respect to said column member.

21. In a device as described in claim 1 wherein, one of said retention means may be optionally mounted for rotation in openings located in the upper extremity of said hand grasp structure.

* * * * *